US005111758A

United States Patent [19]

Nufer et al.

[11] Patent Number: 5,111,758

[45] Date of Patent: May 12, 1992

[54] METHOD OF MAKING GROUPS OF SEWN PATTERNS WITH ZIG-ZAG SEWING MACHINES

[75] Inventors: Karl Nufer, Steckborn, Switzerland; Lorenz Reber, Gaienhofen, Fed. Rep. of Germany

[73] Assignee: Fritz Gegauf Aktiengesellschaft Bernina Nahmaschinenfabrik, Steckborn, Switzerland

[21] Appl. No.: 738,462

[22] Filed: Jul. 31, 1991

[30] Foreign Application Priority Data

Jan. 24, 1991 [CH] Switzerland ..... 00202/91

[51] Int. Cl.[5] ..... D05C 17/00; D05B 3/02

[52] U.S. Cl. ..... 112/266.1; 112/439

[58] Field of Search ..... 112/266.1, 439, 262.3, 112/453, 454, 121.12, 78, 98, 102, 103

[56] References Cited

U.S. PATENT DOCUMENTS

| | | | |
|---|---|---|---|
| 410,428 | 9/1889 | Morley | 112/439 X |
| 2,098,259 | 11/1937 | Schifter | 112/439 |
| 3,872,808 | 3/1975 | Wurst | 112/453 |
| 4,561,369 | 12/1985 | Meier | 112/266.1 |
| 4,649,845 | 3/1987 | Takenoya et al. | 112/439 |

FOREIGN PATENT DOCUMENTS

| | | | |
|---|---|---|---|
| 0883066 | 3/1943 | France | 112/439 |

*Primary Examiner*—Peter Nerbun
*Attorney, Agent, or Firm*—Peter K. Kontler

[57] ABSTRACT

A row of at least two coherent cruciform elementary patterns of stitches is formed in a zig-zag sewing machine by first making a first series of at least two zig-zag stitches and by thereupon making a second series of at least two zig-zag stitches which are mirror images of the stitches of the first series and each of which crosses a different stitch of the first series of stitches. The needle is caused to penetrate into the work in the middle of the first or last stitch of the first series of stitches prior to making the second series of stitches. Each stitch of the first and second series of stitches includes at least one uninterrupted length of thread. Only one crossing point of the stitches which form the first and second series is located at a needle perforation point. The first row of at least two cruciform elementary patterns can be followed by any desired number of additional rows in any desired orientation to form ornamental or other arrays of rows of cruciform patterns.

8 Claims, 2 Drawing Sheets

METHOD OF MAKING GROUPS OF SEWN PATTERNS WITH ZIG-ZAG SEWING MACHINES

CROSS-REFERENCE TO RELATED APPLICATION

The invention which is described and shown in the specification and drawing of the present application is related to the invention which is disclosed in the commonly owned copending patent application Ser. No. 07/738,463 filed Jul. 31, 1991 for "Method of making sewn patterns with sewing machines".

BACKGROUND OF THE INVENTION

The invention relates to a method of making groups (particularly rows) of sewn patterns in zig-zag sewing machines, and to groups (particularly rows) of patterns which are obtained in accordance with the method.

U.S. Pat. No. 4,561,369 to Meier discloses a sewn pattern arrangement which is produced by a zig-zag sewing machine. Each pattern occupies a substantially square area having a length less than the maximum bight range and a width corresponding to the maximum range in the feed direction. Each pattern has sections which extend diagonally of a portion of the respective area. The patent teaches that the width of the rectangular area for each pattern be an integer fraction of the maximum bight width and proposes to have the starting needle penetration point for the making of a next-following pattern coincide with the final needle penetration point of the preceding pattern, i.e., to avoid the making of so-called jump stitches between successive elementary patterns. Each next-following pattern can be formed above, below, laterally adjacent or diagonally of the preceding pattern. The last thread leg of each elementary pattern extends the full length of a diagonal of the respective pattern. Such patterns can be assembled into large-area arrays by grouping rows of elementary patterns side by side.

As a rule, the maximum bight range of a household sewing machine is between 5 and 8 mm, and the maximum range in the feed direction is between 4 to 6 mm, depending upon the design or setting of the mechanism which includes the feed dog. Thus, if the bight range is 8 mm and the range in the feed direction is 6 mm, and assuming that the sewing of patterns in accordance with the teaching of Meier is based on bisection of the bight width, the maximum square area which is available for the making of an elementary pattern is 4×4 mm, and the maximum square area available upon trisection of the bight width is approximately 2.7×2.7 mm. This results in the making of relatively small elementary patterns which are often unacceptable for a number of reasons.

Meier proposes to make various elementary patterns by resorting to different sequences of stitches in each of the patterns, mainly for the purpose of ensuring that a preceding pattern can end in a selected corner of the square area occupied by such pattern, namely in a corner where the making of the next elementary pattern is to begin. Such prerequisite must be met under any and all circumstances if two or more elementary patterns are to be made without jump stitches. Certain elementary patterns must have as many as three needle penetration points at the center of the cruciform pattern (note FIG. 14 of Meier). Each such penetration point at the center of an elementary cruciform pattern entails an interruption of a thread leg, i.e., it is necessary to make two shorter thread legs in lieu of a single thread leg extending all the way between two diagonally opposite corners of the square area which is taken up by an elementary pattern. The number of long thread legs is reduced proportionally with increasing number of needle penetration points at the center of an elementary pattern. Differences in numbers of long thread legs forming part of discrete elementary patterns adversely affect the appearance of an array of two or more elementary patterns. Such differences are more readily apparent if the areas of elementary patterns are relatively large, e.g., if each elementary pattern occupies a square area having sides of a length matching half the maximum bight range.

OBJECTS OF THE INVENTION

An object of the invention is to provide a novel and improved method of making rows or analogous groups of sewn patterns in a zig-zag sewing machine.

Another object of the invention is to provide a method of making relatively large elementary patterns of stitches so that the area which is occupied by an elementary pattern can have a length or a width matching the maximum bight range.

A further object of the invention is to provide a method which can be practiced for the making of any desired number of coherent or separate rows or other groups of elementary cruciform patterns.

An additional object of the invention is to provide a zig-zag sewing machine which can be utilized for the practice of the above outlined method.

Still another object of the invention is to provide a workpiece which exhibits an array of rows of elementary cruciform patterns made in accordance with the above outlined method.

A further object of the invention is to provide a method which renders it possible to fill any selected area of a workpiece with a selected array of identical or different rows of cruciform patterns.

Another object of the invention is to provide a method which renders it possible to form a succession of identical or different rows of elementary patterns.

An additional object of the invention is to provide a method which renders it possible to reduce to zero or to minimize the number of needle penetration points in regions other than at the corners of an elementary cruciform pattern.

Another object of the invention is to provide a method which renders it possible to vary at will the number of long thread legs in each elementary cruciform pattern of a row of such elementary patterns.

A further object of the invention is to provide a method which renders it possible to reduce the number of or to eliminate all short thread legs in an elementary cruciform pattern.

SUMMARY OF THE INVENTION

One feature of the present invention resides in the provision of a method of stitching at least one row of at least two cruciform patterns with a movable needle and a thread in a work (workpiece) on a zig-zag sewing machine. The improved method comprises the steps of making a first series of zig-zag stitches including a first stitch and a last stitch, thereupon making a second series of zig-zag stitches which are mirror images of the stitches of the first series and each of which crosses a different stitch of the first series, and effecting a penetration of the needle into the work substantially in the middle of at least one of the first and last stitches of the first series prior to the making of the second series of stitches.

The step of making the first series of stitches can include sewing a first sequence of zig-zag stitches of at least two threads in a first direction, and thereupon sewing a second sequence of zig-zag stitches over the first sequence of stitches in a second direction counter to the first direction.

The step of making the second series of stitches can also comprise sewing a first sequence of zig-zag stitches of at least two threads in one of the first and second directions, and thereupon sewing a second sequence of zig-zag stitches over the first sequence of the second series in the other of the first and second directions.

The first series of stitches can include at least two overlapping threads, and the second series of stitches can include at least three overlapping threads. Such method can further comprise the steps of arresting the sewing machine upon completed making of the second series of stitches and while the needle extends into the work, restarting the machine, and thereafter stitching a second row of at least two cruciform patterns.

The method can also comprise the step of manually selecting the number of threads in the stitches and the area of a row of cruciform patterns prior to making of the first series of stitches.

Still further, the method can comprise the steps of storing information pertaining to the number of stitches in the first and second series of stitches and the number of rows prior to making of the first series of stitches, and utilizing the stored information to carry out the making and effecting steps. Such method can further comprise the steps of arresting the machine upon completion of the second series of stitches, manually selecting the area of the work for a next-following row of at least two cruciform patterns, and manually restarting the machine upon completion of the selecting step.

Another feature of the invention resides in the provision of a product of manufacture which comprises a workpiece adapted to be sewn by the needle of a zig-zag sewing machine, and at least one row of cruciform patterns of stitches on the workpiece. The at least one row is composed of a first series of zig-zag stitches including a first stitch and a last stitch, and a second series of zig-zag stitches which are mirror images of the stitches of the first series and each of which crosses one stitch of the first series. The workpiece has a needle perforation point substantially in the middle of at least one of the first and last stitches of the first series of stitches.

The novel features which are considered as characteristic of the invention are set forth in particular in the appended claims. The improved method itself, however, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
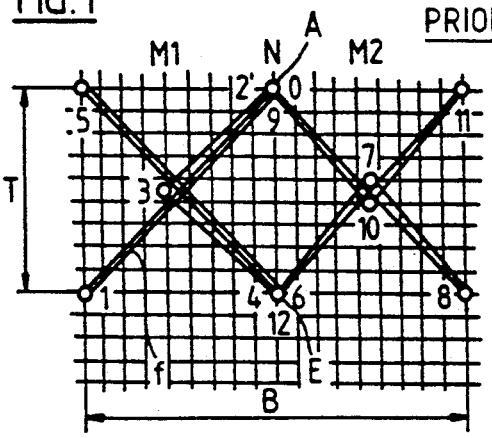
FIG. 1 PRIOR ART
FIG. 1 is a diagrammatic view of a pair of coherent conventional elementary sewn patterns.
Figure 2:
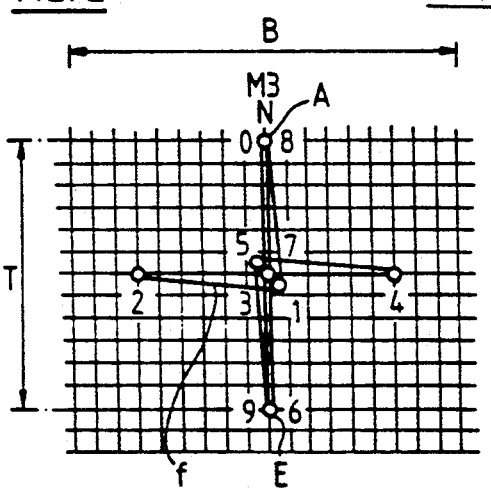
FIG. 2 PRIOR ART
FIG. 2 is a similar view of a third conventional elementary sewn pattern.

FIG. 1 shows two elementary sewn patterns of the type disclosed in the patent to Meier (see FIG. 13 of the reference), and FIG. 2 shows an elementary pattern corresponding to that shown in FIG. 14 of the patent to Meier. The character B denotes the maximum bight range within which the needle of the sewing machine of Meier can form a stitch, and the character T denotes the maximum range in the feed direction, i.e., the maximum length of incremental advances of the work by the feed dog of the sewing machine.

The elementary patterns M1 and M2 of FIG. 1 are based on a bisection of the bight range B, i.e., the width of the pattern M1 or M2 at most equals B/2. The single elementary pattern M3 of FIG. 2 is turned through 45° relative to the pattern M1 or M2 of FIG. 1, and the maximum length of its thread legs (such as a continuous thread leg between the starting and final penetration points A and E in FIG. 2) equals the maximum length of a (diagonal) thread leg of the pattern M1 or M2, e.g., between the needle penetration points 0 and 1 in the pattern M1. The purpose of the pattern M3 is to establish connections between rows of assembled elementary patterns (see FIGS. 15 through 18 of Meier).

When the needle which is used to sew the pattern M1, M2 or M3 of Meier is caused to assume its neutral position N, it is located midway between the ends of the bight range B. If such needle is to be used for the making of the pattern M1, it is caused to penetrate the work at the points 0, 1, 2, 3, 4, 5 and 6. The thread legs f are formed in response to movements which are imparted by first and second stepping motors (51 and 70 in FIG. 1 of Meier) which respectively control the bight or stitch width of the needle and the work feed of the sewing machine. In the pattern M1 of Meier, the first two thread legs form a (diagonal) first stitch between the penetration points 0 and 1 across one half of the bight range B (the first thread leg f extends from 0 to 1 and the second thread leg f extends from 1 back to 0), the third thread leg (having a length f/2) extends from 1 to 3, and the fourth thread leg (f/2) extends from 3 to 4. Each of the third and fourth thread legs extends across one-fourth of the range B. The next two thread legs (each having a length f) are formed as a result of penetration of the needle first at 4 and then at 5 and subsequent penetration at the point 6. This completes the making of the pattern M1, and the making of the pattern M2 begins by forming a thread leg (f/2) between the points 6 and 7, i.e., the starting point of the pattern M2 coincides with the final point E of the pattern M1. The making of the pattern M2 then proceeds by forming thread legs between the points 7 and 8, 8 and 9, 9 and 10, 10 and 11, and 11 and 12 (i.e., back to the point E). In contrast to the pattern M1, the sewing of the pattern M2 necessitates the making of two penetration points 7 and 10 at the crossing point of the two diagonally extending halves of the pattern M2. The pattern M1 comprises four full-length thread legs f (two between the points 0 and 1 and two between the points 4 and 5), whereas the pattern M2 only comprises two full-length thread legs f (namely one between the points 8 and 9 and the other between the points 11 and 12). All other thread legs are shorter, i.e., they have a length f/2.

The making of the pattern M3 of Meier is analogous to the making of the pattern M1 or M2. The making begins at A and is terminated at E, and the needle is caused to penetrate into the work at the points 0 to 9 in such order. FIG. 2 shows that the sewing of the pattern M3 necessitates three penetrations of the needle at the center of the pattern. The last formed thread leg of each of the patterns M1, M2 and M3 has a length f.

Figure 3:
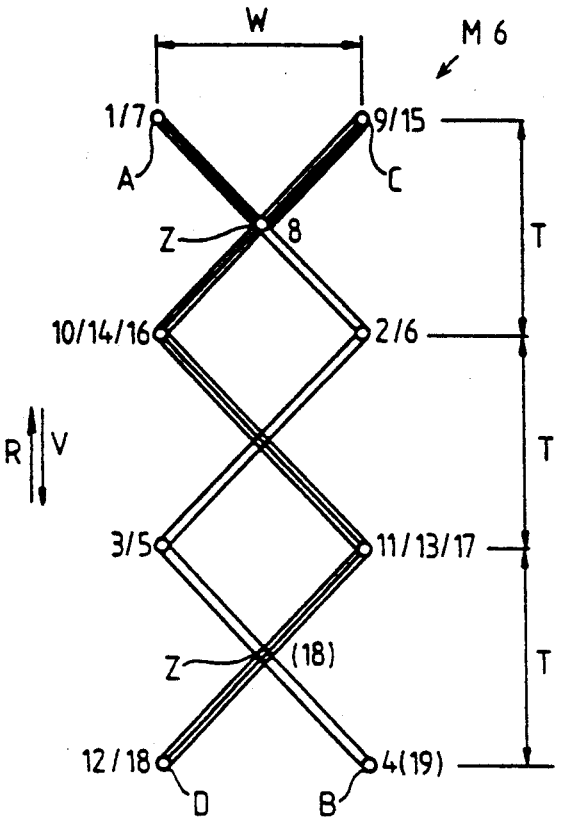
FIG. 3 is a diagrammatic view of a row or group of three elementary cruciform patterns which is made in accordance with a first embodiment of the improved method.

FIG. 3 shows the making of a row or group M6 (hereinafter called row) of elementary patterns in accordance with the method of the present invention. The method is practiced by resorting to a multiple-thread zig-zag sewing machine with an even number of threads. The bight range W is selected in such a way that it matches the selected range T of the feed dog of the machine. The steps of the method include making a sequence of at least two zig-zag stitches in the feed direction (arrow V) and thereupon making a sequence of an equal number of zig-zag stitches in a second direction (arrow R) counter to the feed direction and in such a way that the stitches made in the direction of arrow V are overlapped by stitches made in the direction of arrow R. The last stitch overlaps the first stitch and each stitch includes at least two threads. This completes the making of a first series (two sequences) of zig-zag stitches.

The first penetration of the needle takes place at the point 1 at the left-hand side of the field for the making of a row M6 of elementary patterns, the second penetration point is at 2, the third penetration point is at 3 and the fourth penetration point is at 4. This completes the making of the first sequence of three zig-zag stitches. At the same time, the work is fed in the direction of arrow V, and the penetration points 1, 3 and 2, 4 are disposed at opposite sides of the field. The direction of feed is then changed from V to R, and the needle is caused to penetrate the work at the points 5, 6 and 7 in such order. Thus, the point 5 coincides with or is adjacent the point 3, the point 6 coincides with or is adjacent the point 2, and the point 7 coincides with or is adjacent the point 1. This completes the making of the second sequence of zig-zag stitches and the making of the first series of three stitches. In order to ensure that the diagonally extending threads of the second series of stitches (from 9–18) can be sewn to the threads of the first series (from 1 to 7), it is desirable to make an intermediate penetration at the point Z8 in the middle of the first stitch (between the points 1 and 2). Thus, when the needle penetrates the work at the point 7, the work is moved in the direction of arrow V and the needle penetrates the work again at the point Z8 prior to penetration at the point 9. From there, the needle is caused to penetrate at the points 10, 11, 12, 13, 14, 15, 16, 17, 18, Z18 and 19. Penetrations at the points 10, 11 and 12 (completion of the first sequence of zig-zag stitches of the second series of three stitches) are made while the work is fed in the direction of arrow V, and penetrations at the points 13, 14 and 15 (completion of the second sequence of zig-zag stitches of the second series of stitches) are made while the work is fed in the direction of arrow R. When the needle reaches the point 15, the machine has completed the making of three cruciform elementary patterns which together form a row M6 having a width W and a length 3T. The four corners of the row M6 are located at A, B, C and D. This row is assembled of the two series of zig-zag stitches, with each stitch of the second series constituting a mirror image of and crossing a different stitch of the first series.

The stitches between the penetration points 15, 16, 17 and 18 are made if it is desired to begin the making of a second row M6 of elementary patterns at the point D. The machine is then brought to a halt while the needle extends through the work at the point 18. If the next row M6 of patterns is to be located to the right of the completed first row (namely to start at the point B) and a zig-zag is sewn first with an uneven number of threads the machine is caused to make a first additional stitch between the points 18 and Z18 and a second additional stitch between the points Z18 and 19.

Figure 4:
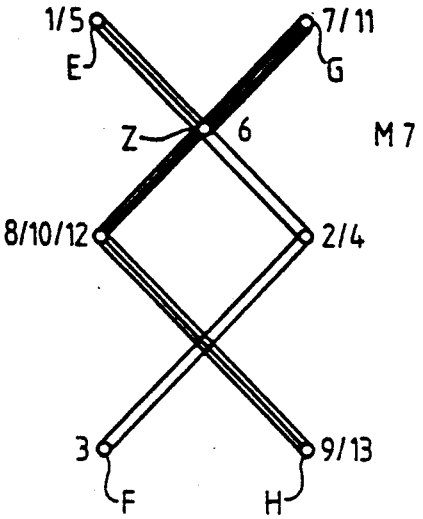
FIG. 4 is a diagrammatic view of a group or row of two elementary cruciform patterns which is made in accordance with a second embodiment of the improved method.

FIG. 4 shows a row M7 of two cruciform elementary patterns. Each zig-zag stitch consists of only two stitches which extend at right angles to each other. The sequence of penetrations is from the point 1 to the points 2, 3, 4, 5, Z6, 7, 8, 9, 10, 11. If the next row is to be started at H, it is necessary to make two additional stitches, namely between the points 11, 12 and between the points 12, 13. The four corners of the row are located at E, F, G and H.

It is clear that the number of elementary cruciform patterns in a row can be increased to four or more. Furthermore, it is possible to make thread legs with more than two or three threads, for example, by adding in FIG. 3 or 4 stitches which overlap the illustrated stitches. Still further, it is possible to reverse the direction of successive penetrations, e.g., to start at 19 in FIG. 3 and to proceed toward 1.

It is also within the purview of the invention to make rows of patterns which include elementary cruciform patterns having different sizes, i.e., the area of each elementary pattern need not equal W times T. Furthermore, at least some elementary patterns can be designed to occupy rectangular (rather than square) areas. The height of one or more elementary cruciform patterns can exceed the width or vice versa. This entails corresponding changes in the dimensions of a row or group of such elementary patterns.

A multiple-thread zig-zag pattern with an even number of threads preferably consists of two or four overlapping zig-zag stitches, and a multiple-thread zig-zag pattern with an uneven number of threads preferably consists of three or five overlapping stitches. Even though the uneven number of threads is hardly detectable and does not affect the appearance of the cruciform patterns, it is advisable to sew the zig-zag pattern with the larger number of threads last because this results in complete concealment of the intermediate penetration point or points Z which is or are necessary to form series of zig-zag stitches in the opposite direction.

The first and last penetration points A and D of a row M6 consisting of an uneven number of elementary patterns are located opposite each other as considered in the direction of feed but at the same side of the area. If a row M7 has an even number of elementary patterns, the first and last penetration points (E and H) are located at opposite sides of the field.

The rows of elementary cruciform patterns can be assembled into arrays or larger groups, and such rows can have identical or different numbers of elementary patterns. Next-following rows can be located to the left or to the right of the preceding rows. Moreover, the width of one or more rows can depart from the width of the other row or rows. Still further, the length of stitches can vary from row to row. All this renders it possible to form a number of different ornamental arrays of cruciform elementary patterns or to assemble such patterns into images of objects or persons.

Figure 5:
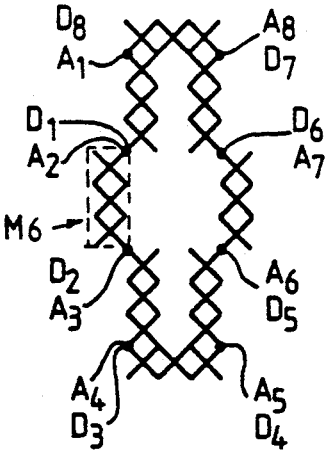
FIG. 5 shows an array of eight groups or rows of elementary patterns of the type shown in FIG. 3.

FIG. 5 shows a first array which is assembled of eight rows M6 of elementary patterns of the type shown in FIG. 3. The first row M6 extends between the points A1 and D1, the second row extends between the points A2 (coinciding with D1) and D2, the third row extends between the points A3 (coinciding with D2) and D3, and so forth. The last row extends from the point A8 (coinciding with the last point D7 of the penultimate row) to the point D8 which coincides with the point A1. The second row M6 (between A2 and D2) is offset to the left from the first row (between A1 and D1), the third row (between A3 and D3) is aligned with but is spaced apart from the first row, and the fifth, sixth and seventh rows (between A5 and D5, A6 and D6, A7 and D7) are mirror images of the first, second and third rows. The fourth row (between A4 and D4) extends transversely between the third and fifth rows, and the eighth row (between A8 and D8) extends transversely between the first and seventh rows.

The order in which the eight rows M6 of elementary patterns of FIG. 5 are made can be reversed from the illustrated counterclockwise to a clockwise direction. Thus, the making of the first row (D1 to A1) can be followed by the making of the row D8 to A8, by the making of the row D7 to A7, and so forth to the making of the last row D2 to A2.

Figure 6:
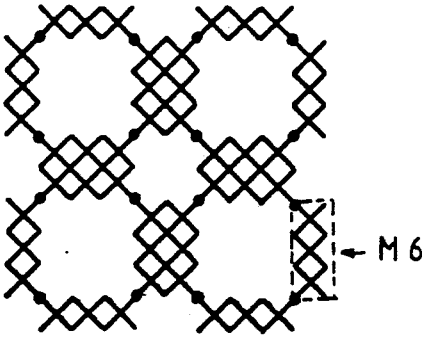
FIG. 6 shows a different array consisting of sixteen groups or rows of elementary patterns of the type shown in FIG. 3.

FIG. 6 shows a different array which occupies a relatively large square area and is assembled of a total of sixteen rows M6 of three elementary cruciform patterns each.

Figure 7:
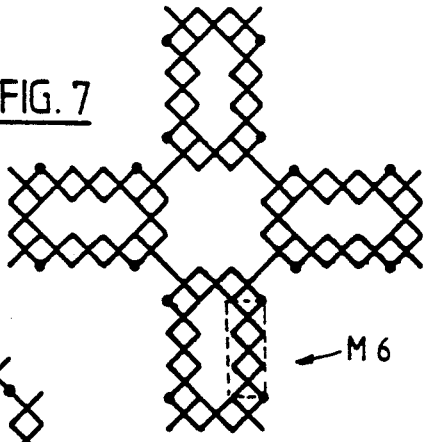
FIG. 7 illustrates a third array consisting of twelve groups or rows of elementary patterns of the type shown in FIG. 3.

FIG. 7 depicts a cruciform array which is made of a total of twelve rows M6 of the type shown in FIG. 3.

Figure 8:
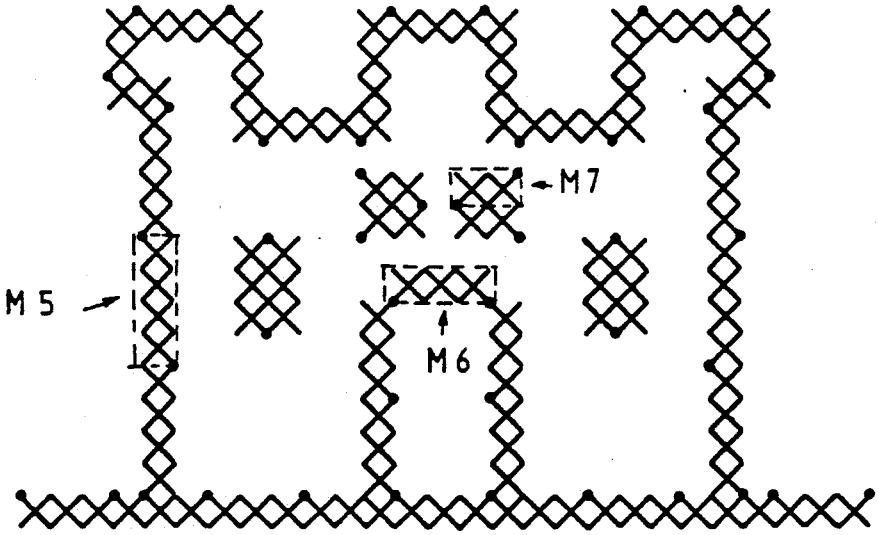
FIG. 8 shows a fourth array which includes groups or rows of elementary patterns of the type shown in FIGS. 3 and 4 and groups or rows consisting of more than three elementary cruciform patterns.

Referring to FIG. 8, there is shown an array which is made of rows of the type shown in FIGS. 3 and 4 and rows having larger numbers of elementary cruciform patterns. The rows include several rows M5 with four elementary patterns each, rows M6 which are identical with the row of FIG. 3, and rows M7 which are identical with the row of FIG. 4.

Figure 9:
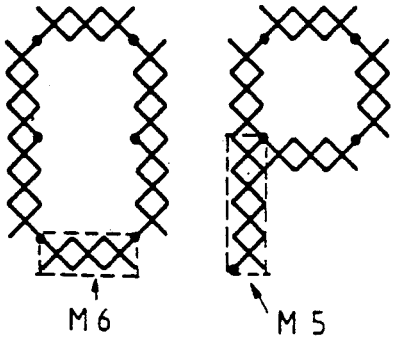
FIG. 9 shows an additional array made of a total of eleven groups or rows including ten rows of the type shown in FIG. 4 and a row containing four elementary cruciform patterns.

The letters "O" and "P" which are shown in FIG. 9 are made from ten rows M6 and one row M5.

The information which is needed to make the arrays of FIGS. 5 to 9 or any one of a practically infinite number of additional arrays can be stored in the electronic memory of the sewing machine in response to input signals from the operator. The stored information can be read in any desired sequence, depending on the selected array or arrays, and the machine then proceeds to automatically sew the selected arrays of rows of elementary cruciform patterns. It is preferred to cause the needle of the sewing machine to extend into the work upon completion of each row of elementary patterns so that the operator can readily change the orientation of the work relative to its support if such change of orientation is necessary. For example, a change of orientation of the work will take place between the making of the third (A3 to D3) and fourth (A4 to D4) rows M6 of FIG. 5. When a change of orientation is completed, the machine is preferably restarted by hand, i.e., the operator actuates a starter switch or another suitable starting device of the sewing machine.

A zig-zag sewing machine which can be utilized for the practice of the method of the present invention is described and shown in U.S. Pat. No. 3,872,808 granted Mar. 25, 1975 to the Singer Company.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of stitching at least one row of at least two cruciform patterns with a movable needle and a thread in a work on a zig-zag sewing machine, the work including a field having first and second sides, comprising the steps of making in the field a first series of zig-zag stitches including a first stitch and a last stitch; effecting a penetration of the needle into the field substantially in the middle of at least one of the first and last stitches of the first series of the stitches; and thereupon making in the field a second series of zig-zag stitches which are mirror images of the stitches of the first series and each of which crosses one stitch of the first series of stitches, each of said stitches extending between the two sides of the field.

2. The method of claim 1, further comprising the steps of manually selecting the number of threads in the stitches and the area of the at least one row prior to making of the first series of stitches.

3. The method of claim 1, further comprising the steps of storing information pertaining to the number of stitches in the first and second series of stitches and the number of rows prior to making of the first series of stitches, and utilizing the stored information to carry out said making and effecting steps.

4. A method of stitching at least one row of at least two cruciform patterns with a movable needle and a thread in a work on a zig-zag sewing machine, comprising the steps of making a first series of zig-zag stitches including a first stitch and a last stitch, said steps including sewing a first sequence of zig-zag stitches of at least two threads in a first direction and thereupon sewing a second sequence of zig-zag stitches in a second direction counter to said first direction; effecting a penetration of the needle into the work substantially in the middle of at least one of the first and last stitches of the first series of stitches; and thereupon making a second series of zig-zag stitches which are mirror images of the stitches of the first series and each of which crosses one stitch of the first series of stitches.

5. The method of claim 4, wherein the step of making said second series of stitches includes sewing a first sequence of zig-zag stitches of at least two threads in one of said directions, and thereupon sewing a second sequence of zig-zag stitches over the first sequence of the second series of stitches in the other of said directions.

6. A method of stitching at least one row of at least two cruciform patterns with a movable needle and at least one thread in a work on a zig-zag sewing machine, comprising the steps of making a first series of zig-zag stitches including a first stitch and a last stitch, said step including utilizing at least two overlapping threads; effecting a penetration of the needle into the work substantially in the middle of at least one of the first and last stitches of the first series of stitches; and thereupon making a second series of zig-zag stitches which are mirror images of the stitches of the first series and each of which crosses one stitch of the first series of stitches, said step of making said second series of stitches including using at least three overlapping threads.

7. The method of claim 6, further comprising the steps of arresting the sewing machine upon completed making of the second series of stitches and while the needle extends into the work, restarting the machine, and thereafter stitching a second row of at least two cruciform patterns.

8. A method of stitching at least one row of at least two cruciform patterns with a movable needle in a work on a zig-zag sewing machine, comprising the steps of storing information pertaining to the number of stitches in a first and second series of stitches and the number of rows prior to making the first series of stitches, reading out the stored information; making a first series of zig-zag stitches including a first stitch and a last stitch; effecting a penetration of the needle into the work substantially in the middle of at least one of the first and last stitches of the first series of stitches; thereup making a second series of zig-zag stitches which are mirror images of the stitches of the first series and each of which crosses one stitch of the first series of stitches; arresting the sewing machine upon complete of the second series of stitches; manually selecting the area of the work for a next-following row of at least two cruciform patterns; and manually restarting the machine upon complete of the selecting step.

* * * * *